US006825745B1

(12) United States Patent
Bach et al.

(10) Patent No.: US 6,825,745 B1
(45) Date of Patent: Nov. 30, 2004

(54) LOW-VOLTAGE CIRCUIT-BREAKER WITH A HOUSING HAVING A FRONT PANEL AND A BACK PANEL

(75) Inventors: Michael Bach, Berlin (DE); Detlev Schmidt, Berlin (DE); Michael Sebekow, Berlin (DE); Guenter Seidler-Stahl, Berlin (DE); Ingo Thiede, Berlin (DE); Sezai Tuerkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/148,019

(22) PCT Filed: Nov. 22, 2000

(86) PCT No.: PCT/DE00/04202

§ 371 (c)(1),
(2), (4) Date: May 24, 2002

(87) PCT Pub. No.: WO01/39232

PCT Pub. Date: May 31, 2001

(30) Foreign Application Priority Data

Nov. 26, 1999 (DE) ..... 199 58 943

(51) Int. Cl.[7] ..... H01H 13/04; H01H 9/02

(52) U.S. Cl. ..... 335/202; 335/18

(58) Field of Search ..... 335/16, 18, 147, 335/195, 132, 202; 200/293–308; 361/42–51

(56) References Cited

U.S. PATENT DOCUMENTS 3,553,615 A * 1/1971 Turnbull ..... 335/132
4,084,203 A * 4/1978 Dietz et al. ..... 361/45
4,663,502 A * 5/1987 Kane et al. ..... 200/5 R
4,764,650 A 8/1988 Bur et al.

FOREIGN PATENT DOCUMENTS

| | | | | |
|---|---|---|---|---|
| DE | 1 145 248 | | 4/1963 | |
| DE | 296 15 162 U1 | | 12/1996 | |
| EP | 0 322 321 A1 | | 6/1989 | |
| GB | 420 590 | | 12/1934 | |
| JP | 2 183931 | | 7/1990 | |
| JP | 05002979 | * | 1/1993 | ..... 335/132 |
| JP | 05258657 | * | 10/1993 | ..... 335/202 |
| JP | 6 131963 | | 5/1994 | |
| JP | 8 250013 | | 9/1996 | |

* cited by examiner

*Primary Examiner*—Lincoln Donovan
(74) *Attorney, Agent, or Firm*—Harness, Dickey & Pierce, P.L.C.

(57) ABSTRACT

A low-voltage circuit breaker includes an enclosure. The enclosure includes a front wall and a rear wall, and further includes specific functional subdivisions. The front wall and the rear wall are separated from one another by a separating joint, which runs vertically in the in-use position, between the enclosure front wall and the enclosure rear wall. An integrated cable duct is provided in the base of the enclose rear wall. The cable duct can be covered and extends underneath the contact support bearings and underneath the current transformer chambers which surround the lower connecting rails essentially over the entire width of the low-voltage circuit breaker. In the direction of the enclosure front wall, it has one or more through-opening for the connecting cables to pass through between the current transformers and the electronic tipping unit.

16 Claims, 2 Drawing Sheets

LOW-VOLTAGE CIRCUIT-BREAKER WITH A HOUSING HAVING A FRONT PANEL AND A BACK PANEL

This application is the national phase under 35 U.S.C. § 371 of PCT International Application No. PCT/DE00/04202 which has an International filing date of Nov. 22, 2000, which designated the United States of America, and which claims priority on German Application number 199 58 943.7 filed Nov. 26, 1999, the entire contents of which are hereby incorporated by reference.

FIELD OF THE INVENTION

The invention generally relates to a low-voltage circuit breaker. Preferably, it relates to one having an enclosure which has a front wall and a rear wall, and has specific functional subdivisions. The front wall and the rear wall may be separated from one another by a separating joint, which runs vertically in the in-use position, between the enclosure front wall and the enclosure rear wall.

BACKGROUND OF THE INVENTION

The switching chambers of the circuit breaker are located between the enclosure front wall and the enclosure rear wall. In consequence, it is necessary to remove the enclosure rear wall, in order to gain access to the appropriate assemblies, in order to service or repair the switching contact systems. This can be done after removal of all the screws which connect the enclosure rear wall directly to the enclosure front wall and to the foot plates. In large low-voltage circuit breakers, the enclosure rear wall and the enclosure front wall are relatively large plastic molded parts which engage in one another in an interleaving manner in places, so that it is impossible to avoid the use of a relatively large amount of force being required to separate the enclosure rear wall from the enclosure front wall. If the two parts are tilted with respect to one another or are stuck to one another, this can lead to the enclosure rear wall being moved suddenly in relation to the enclosure front wall.

In this case, it must be remembered that the current transformers are located in the enclosure rear wall and are connected via electrical cables to the electronic tripping unit which is physically mounted in front of the enclosure front wall and controls the protective functions of the circuit breaker. In the event of such a sudden movement or if an excessive amount of force is applied, there is a risk of these connecting cables likewise being stressed suddenly or too severely, and possibly being damaged or being torn out of their connecting terminals.

A low-voltage circuit breaker is disclosed, for example, in U.S. Pat. No. 4,764,650. This low-voltage circuit breaker is provided with a vertical joint between the front wall and the rear wall with specific functional subdivisions and has the switch elements which are arranged between the enclosure parts.

DE-UM 296 15 162 discloses a low-voltage circuit breaker with a current transformer which is arranged concentrically with respect to the connecting rail and with a connecting cable for the overcurrent release, in which the switch rear wall is arranged such that it can be folded backward about a pivoting axis which is located at a deep level and is arranged in a region of the foot plates. This arrangement is intended to avoid the risk of damage to the sensitive electrical cables (tearing off) between the current transformers and the overcurrent releases which are located at the front.

However, it does not actually preclude the risk of a sudden or excessively powerful movement, even though this occurs only as a pivoting movement of the switch rear wall.

SUMMARY OF THE INVENTION

An object of an embodiment of the present invention is to reduce risk or damage to the electrical connecting cables between the current transformers in the enclosure rear wall and the electronic tripping unit, which is mounted physically in front of the enclosure front wall, when the low-voltage circuit breaker is disassembled for servicing or repair purposes.

According to an embodiment of the invention, this object may be achieved in that, particularly in the case of multi-pole low-voltage circuit breakers with an enclosure front wall and an enclosure rear wall, which are separated from one another by a separating joint which runs vertically in the in-use position, an integrated cable duct is provided in the base of the enclosure. It extends underneath the contact support bearings and underneath the current transformer chambers which surround the lower connecting rails, essentially over the entire width of the low-voltage circuit breaker. Further, in the enclosure front wall, it has one or more through-openings for the connecting cables to pass through between the current transformers and an electronic tripping unit on the front face. This cable duct does not overlap other areas of the low-voltage circuit breaker, but forms a completely separate tunnel. It holds all the cable harnesses in an area which is separate from the rest of the low-voltage circuit breaker, and this avoids the risk of damage to the cables during assembly, repair and servicing work on this switch.

The cable duct is closed by a cover plate, which includes a thin and elastic material with sufficient resistance to prevent it from being pushed through into the cable duct. One suitable material may expediently be hard plastic.

In order to hold the over plate for the cable duct, a groove on the enclosure side and with a tab which projects in the groove and runs over the entire length of the cable duct can be provided in the base of the enclosure, into which the cover plate can be latched in order to close the cable duct.

The cover plate is preferably provided with one or more disassembly openings for assembly and disassembly. The cover plate can be inserted into the groove, and removed from it, with the aid of these disassembly openings, without the assistance of any tools, with the tab preventing the cover plate from being pushed through into the cable duct.

BRIEF DESCRIPTION OF THE DRAWINGS

The invention will be explained in more detail in the following text, to assist understanding, using a preferred example, which does not restrict the protective scope of the invention, and with reference to the associated drawings, wherein.

DETAILED DESCRIPTION OF THE PREFERRED EMBODIMENTS

Figure 1:
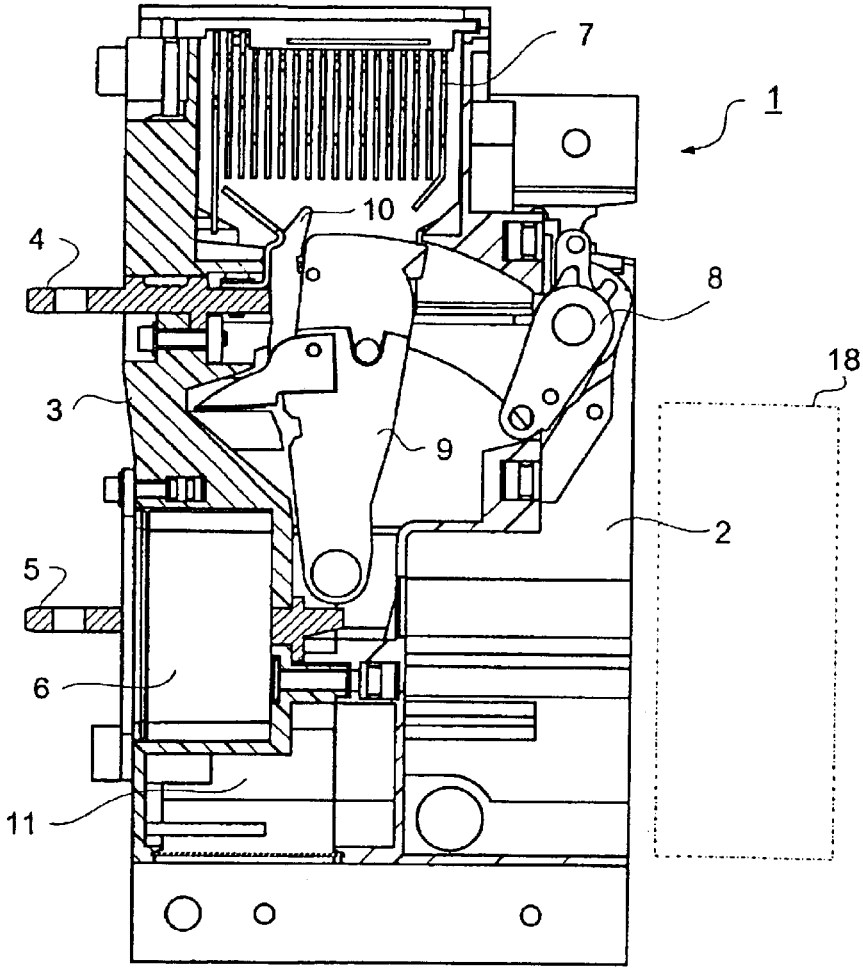
FIG. 1 shows, schematically, a section through a low-voltage circuit breaker, in which the physical arrangement can be seen.

FIG. 1 shows, schematically, a low-voltage circuit breaker 1 with an enclosure front wall 2 and an enclosure rear wall 3, which are separated from one another by a separating joint, which is not shown, illustrated in the form of a section, in which the upper connecting rail 4, the lower connecting rail 5 which passes through the current transformer chamber 6, the arcing chamber 7, the switch drive 8 and the moveable contact support 9 with the moveable switching contact 10 are illustrated, in order to make it possible to see the physical arrangement of the cable duct 11 according to an embodiment of the invention in the enclosure between the rear wall 3 and the front wall 2.

Figure 2:
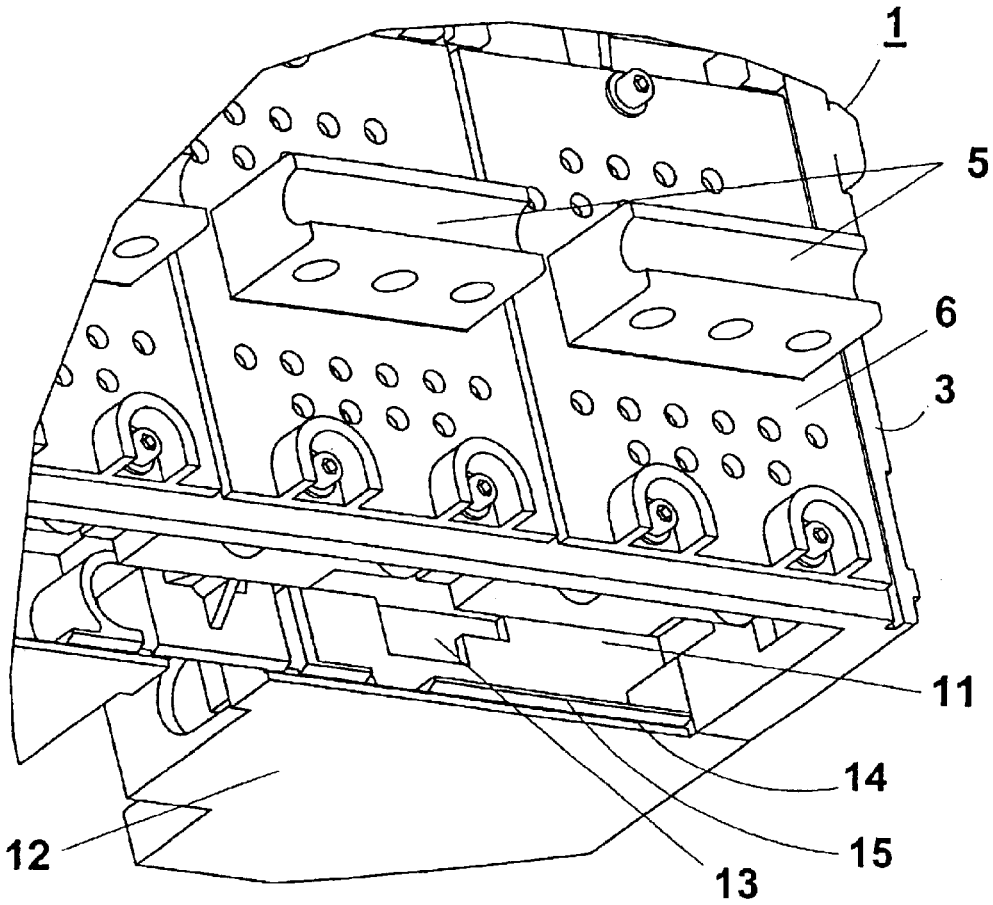
FIG. 2 shows, schematically, a perspective view of a three-pole low-voltage circuit breaker from underneath at the rear, in which the open cable duct according to an embodiment of the invention can be seen.

As can be seen in FIG. 2, this cable duct 11 extends in the base 12 of the enclosure of the low-voltage circuit breaker 1 underneath the contact support bearings, which cannot be seen, and the current transformer chambers 6, which surround the lower connecting rails 5 and are covered in the illustration, essentially over the entire width of the low-voltage circuit breaker 1. In the enclosure front wall 2, the cable duct 11 has a through-opening 13 for the connecting cables to pass through between the current transformers and an electronic tripping unit 18, which is indicated by dashed-dotted lines.

Figure 3:
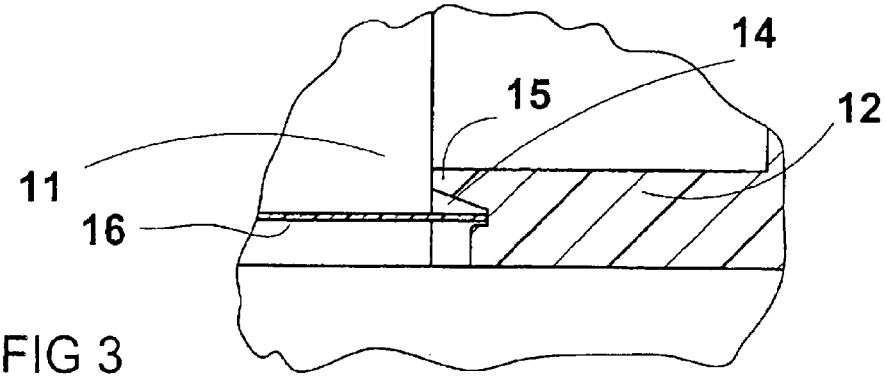
FIG. 3 shows a detail of the groove on the enclosure side for holding the cover plate for the cable duct.
Figure 4:
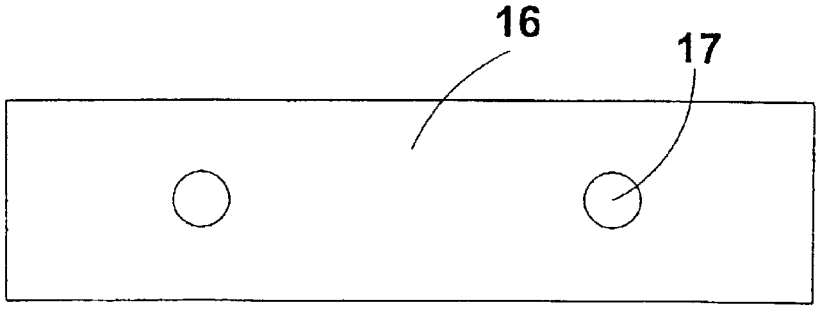
FIG. 4 shows one possible embodiment of the cover plate for the cable duct.

A cover plate 16, one possible embodiment of which is illustrated in FIG. 4, for closing the cable duct 11 can be latched in a groove 14 on the enclosure side in the base 12 of the enclosure, which is shown schematically in detail in FIG. 3 and has a tab 15 which projects in the groove 14 and runs over the entire length of the cable duct 11. This cover plate 16, which is produced, for example, from hard plastic, is provided with two disassembly openings 17 for assembly and disassembly. The cover plate 16 can be inserted into and removed from the groove 14 by these disassembly openings 17 without the assistance of any tools, with the tab 15 preventing the cover plate 16 from being pushed through into the cable duct 11.

The advantage of this arrangement is that channels for the cables from the sensors to the overcurrent release and indicating instruments can be provided even while the enclosure parts are being manufactured, and the cables cannot be damaged in these channels. The circuit breaker can be disassembled without any problems for repair and servicing work, without any danger to the cables.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A circuit breaker, comprising:

an enclosure, including a front wall and a rear wall, and including specific functional subdivisions, with the front wall and the rear wall being separated from one another by a separating joint which runs vertically in the in-use position, between the enclosure front wall and the enclosure rear wall; and an integrated cable duct, provided in the enclosure between the rear wall and the front wall, extending underneath contact support bearings and underneath current transformer chambers which surround lower connecting rails, essentially over the entire width of the circuit breaker, wherein, in the enclosure front wall, the integrated cable duct includes at least one opening through which connecting cables can pass, between the current transformers and an electronic tripping unit on the front wall.

2. The circuit breaker as claimed in claim 1, wherein the cable duct is closed by a cover plate, including a thin and elastic material.

3. The circuit breaker as claimed in claim 2, wherein the cover plate includes a hard plastic.

4. The circuit breaker as claimed in claim 1, further comprising:

a groove on the enclosure side; and a tab, projecting in the groove and running over an entire length of the cable duct, for holding the cover plate for the cable duct in the base of the enclose.

5. The circuit breaker as claimed in claim 1, wherein the cover plate includes at least one disassembly opening for at least one of assembly and disassembly.

6. The circuit breaker as claimed in claim 2, further comprising:

a groove on the enclosure side; and a tab, projecting in the groove and running over an entire length of the cable duct, for holding the cover plate for the cable duct in the base of the enclosure.

7. The circuit breaker as claimed in claim 2, wherein the cover plate includes at least one disassembly opening for at least one of assembly and disassembly.

8. The circuit breaker as claimed in claim 4, wherein the cover plate includes at least one disassembly opening for at least one of assembly and disassembly.

9. The circuit breaker of claim 1, wherein the integrated cable duct is provided in a base of the enclosure.

10. The circuit breaker of claim 1, wherein the circuit breaker is a low-voltage circuit breaker.

11. An enclosure for a circuit breaker, comprising:

a front panel portion;

a rear panel portion; and an integrated cable channel, provided in the enclosure between the rear panel portion and the front panel portion, extending underneath contact support bearings and underneath current transformer chambers which surround lower connecting rails, essentially over the entire width of the circuit breaker, wherein, in the enclosure front panel portion, the integrated cable channel includes at least one opening through which connecting cables can pass, between current transformers and an electronic tripping unit on the front panel portion.

12. The enclosure of claim 11, further comprising:

a separating joint between the enclosure front panel portion and the enclosure rear panel portion.

13. The enclosure as claimed in claim 11, wherein the cable duct is closed by a cover plate, including a thin and elastic material.

14. The enclosure as claimed In claim 13, wherein the cover plate includes a hard plastic.

15. The enclosure as claimed in claim 11, further comprising:

a groove on the enclosure side; and a tab, projecting in the groove and running over an entire length of the cable duct, for holding the cover plate for the cable duct in the base of the enclosure.

16. The enclosure as claimed in claim 11, wherein the cover plate includes at least one disassembly opening for at least one of assembly and disassembly.

* * * * *